US010427064B2

(12) United States Patent
Xiong et al.

(10) Patent No.: US 10,427,064 B2
(45) Date of Patent: Oct. 1, 2019

(54) BUILDING BLOCK SET AND BUILDING BLOCK ROBOT

(71) Applicant: UBTECH Robotics Corp., Shenzhen (CN)

(72) Inventors: Youjun Xiong, Shenzhen (CN); Dingkai Xing, Shenzhen (CN); Yumiao Wu, Shenzhen (CN); Lefeng Liu, Shenzhen (CN)

(73) Assignee: UBTECH ROBOTICS CORP., Shenzhen (CN)

( * ) Notice: Subject to any disclaimer, the term of this patent is extended or adjusted under 35 U.S.C. 154(b) by 377 days.

(21) Appl. No.: 15/460,240

(22) Filed: Mar. 16, 2017

(65) Prior Publication Data

US 2018/0169534 A1 Jun. 21, 2018

(30) Foreign Application Priority Data

Dec. 15, 2016 (CN) ..... 2016 1 11617714

(51) Int. Cl.
*A63H 33/04* (2006.01)

(52) U.S. Cl.
CPC ..... *A63H 33/042* (2013.01)

(58) Field of Classification Search
CPC ..... A63H 18/00; A63H 18/02; A63H 18/021; A63H 19/00; A63H 19/30
See application file for complete search history.

(56) References Cited

U.S. PATENT DOCUMENTS 4,941,610 A * 7/1990 Frauca ..... A63H 18/02 238/10 A
7,770,524 B1 * 8/2010 Wa ..... A63H 18/08 104/140

* cited by examiner

*Primary Examiner* — Robert J McCarry, Jr.

(57) ABSTRACT

The present disclosure relates to a building block set including at least two building components that can be built together to form at least one track. The building block set includes a base, fixing brackets, and a partition sheet. Each fixing bracket includes a pair of supporting sheets facing each other, a pivot shaft connected between the two supporting sheets, and two hook-shaped portions respectively extending from the supporting sheets along a direction away from the pivot shaft.

18 Claims, 4 Drawing Sheets

BUILDING BLOCK SET AND BUILDING BLOCK ROBOT

CROSS REFERENCE TO RELATED APPLICATIONS

This application claims priority to Chinese Patent Application No. 201611161714.6, filed Dec. 15, 2016 which is hereby incorporated by reference herein as if set forth in its entirety.

BACKGROUND

1. Technical Field

The present disclosure generally relates to the field of smart toy technology, and particularly to a building block set and a building block assembly assembled by the building block set.

2. Description of Related Art

With the improvement of people's living standards, children's intellectual development has drew more and more attention. Building blocks not only can entertainment children, but also contribute to three-dimensional ability and practical ability, and thus are very popular for parents and children. Among a variety of building block toys, tracks are key components for toys, such as tanks or trains. Nevertheless, conventional tracks are designed to be assembled together, that is, the conventional track cannot be built alone. To this end, providing a convenient track for the building block that can be easily built is one technical problems to be solved.

SUMMARY

The present disclosure relates to a building block set, wherein the tracks can be built alone.

In one aspect, a building block set includes: at least two building components engaging with each other, each of the building components comprising a base, a pair of fixing brackets protrusive from one side of the base, and a partition sheet connected between the two fixing brackets; each of the fixing brackets comprising a pair of supporting sheets facing toward each other, a pivot shaft connected between the two supporting sheets, and two hook-shaped portions respectively extending from the supporting sheets along a direction facing away the pivot shaft; and the partition sheet of each of the building components are connected between two adjacent supporting sheets of the two fixing brackets.

Wherein the fixing brackets of each of the building block further includes a connecting sheet arranged between the two supporting sheets, the connecting sheet protrudes from a surface of the base, each of the hook-shaped portions protrudes from the connecting sheet along a first horizontal direction, and the supporting sheets protrude from the connecting sheet along a second horizontal direction, and the first horizontal direction is opposite to the second horizontal direction.

Wherein each of the hook-shaped portions of the building components includes an adapter board extruding from a surface of the connecting sheet along the first horizontal direction, the adapter board is configured with an importing port and an engaging hole communicating with each other, when the pivot shaft of one building block is fastened to the adjacent building component, the pivot shaft engages with the engaging hole along the importing port, the importing port includes a first end and a second end, the first end is closer to the engaging hole than the second end, and a diameter of the engaging hole is greater than a width of the first end of the importing port.

Wherein an axial length of the pivot shaft is the same with the axial length of the engaging hole, and a height of the pivot shaft is the same with the height of the engaging hole.

Wherein the adapter board includes an arc surface facing away the connecting sheet.

Wherein the supporting sheet includes a top surface and a lateral surface, the top surface extends from the connecting sheet along the second horizontal direction, and the lateral surface extends from the base along a vertical direction, and the top surface and the lateral surface are connected by an arc surface.

Wherein the base of each of the building components is configured with a pair of expansion slots arranged on outer sides of the fixing brackets.

Wherein a cross section of each of the expansion slots along a surface parallel to the base is a rectangle or a circle.

In another aspect, a building block assembly includes the above building block set, and the building components are built together to form at least one track.

Wherein the building block assembly further includes a rolling wheel engaging with the track, the rolling wheel includes at least one frame having at least one central connecting hole and a plurality of wheel teeth surrounding an outer circumference of the frame.

Wherein a receiving space is formed between the partition sheets of two adjacent building components, and the receiving space is configured to engage with the wheel teeth, a tooth slot is formed between two adjacent wheel teeth, and the central connecting hole is configured to connect the power component.

Wherein the frame also includes a plurality of connecting holes surrounding the central connecting hole, wherein the angle formed by the central connecting hole on the central axial line and any one of the connecting holes is the same.

In view of the above, the building block are built together to form the track such that toys, such as tanks or trains, may move on the track smoothly. Specifically, each of the building components are respectively configured with a pivot shaft so as to engage with the hook-shaped portions of the adjacent building components. The partition sheet of each of the building components are connected between two adjacent supporting sheets to form the track or an intermediate connecting component of the track. As such, the two fixing brackets are stably fixed, and toys such as tanks or trains may work on the track. The structure is pretty simple and can be easily built, and the built structure is stable.

Other objects, advantages and novel features of the invention will become more apparent from the following detailed description when taken in conjunction with the accompanying drawings.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

Figure 1:
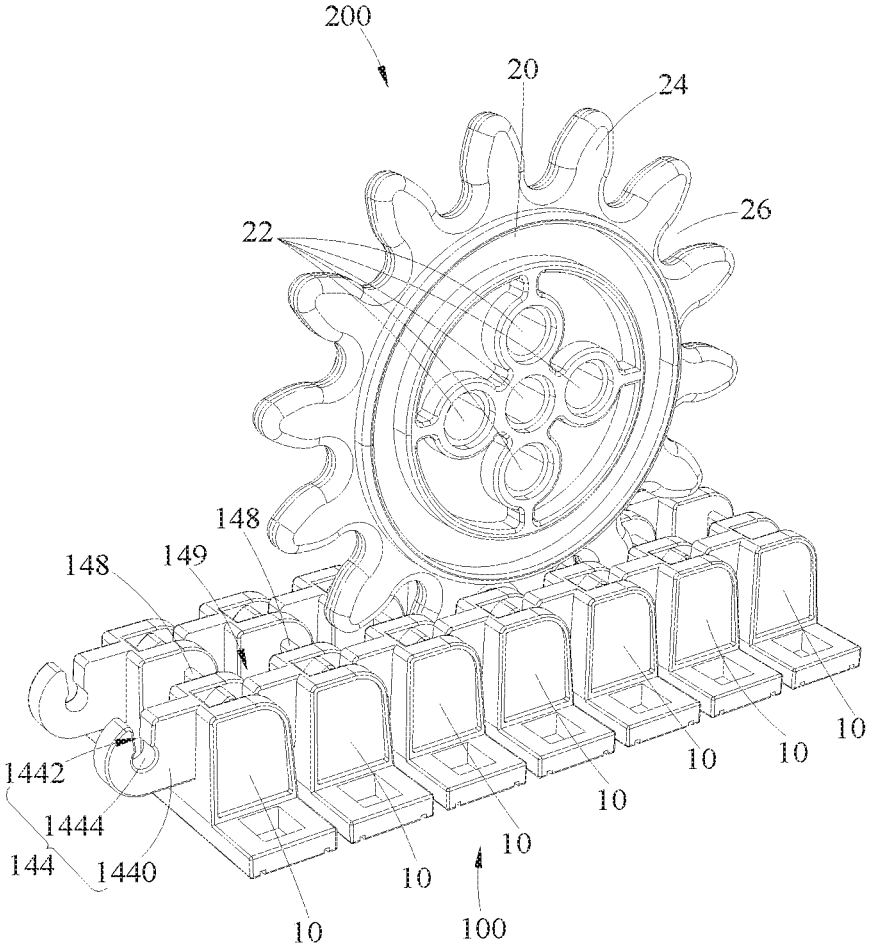
FIG. 1 is a partial schematic view of the building block assembly in accordance with one embodiment.

The disclosure is illustrated by way of example and not by way of limitation in the figures of the accompanying drawings, in which like reference numerals indicate similar elements. It should be noted that references to "an" or "one" embodiment in this disclosure are not necessarily to the same embodiment, and such references can mean "at least one" embodiment.

In the description of the claimed invention, it should be understood that the orientation or positional relationship indicated by terms, "length", "width", "upper", "lower", "front", "rear", "left", "right", "vertical", "horizontal", "top", "bottom", "inside", and "outside", are based on the orientation or the positional relationship shown in the drawings. That is, these terms are mainly adopted to simplify the descriptions of the present disclosure, instead of being construed as limitations of the claimed invention.

In addition, the terms "first" and "second" are only used to indicate or imply relative importance or the number of technical features specified or implicitly indicated. Thus, the technical features defined by the "first" or the "second," may explicitly or implicitly refer to at least one or more technical features. In the present disclosure, a "plurality of" means "at least two" or "more than two", unless otherwise expressly specifically limited.

In the present disclosure, unless otherwise clearly defined and limited, the term "mounted," "connected," "connected," "fixed" and other terms should have been broadly understood. For example, such term may refer to a fixed connection, a detachable connection or an integrally formed connection; or such term may refer to mechanically connected, or electrically connected; or such term may refer to directly connected, indirectly connected through an intermediate media, or may be two elements internally connected or an interaction between two elements, unless otherwise expressly limited. Persons of ordinary skills can conceive the above-mentioned terms in view of the present disclosure.

In order to further illustrate the purpose, the technical solutions, and the advantages of the claimed invention, the claimed invention will be described in accordance with the accompanying drawings and the embodiments hereinafter.

Figure 2:
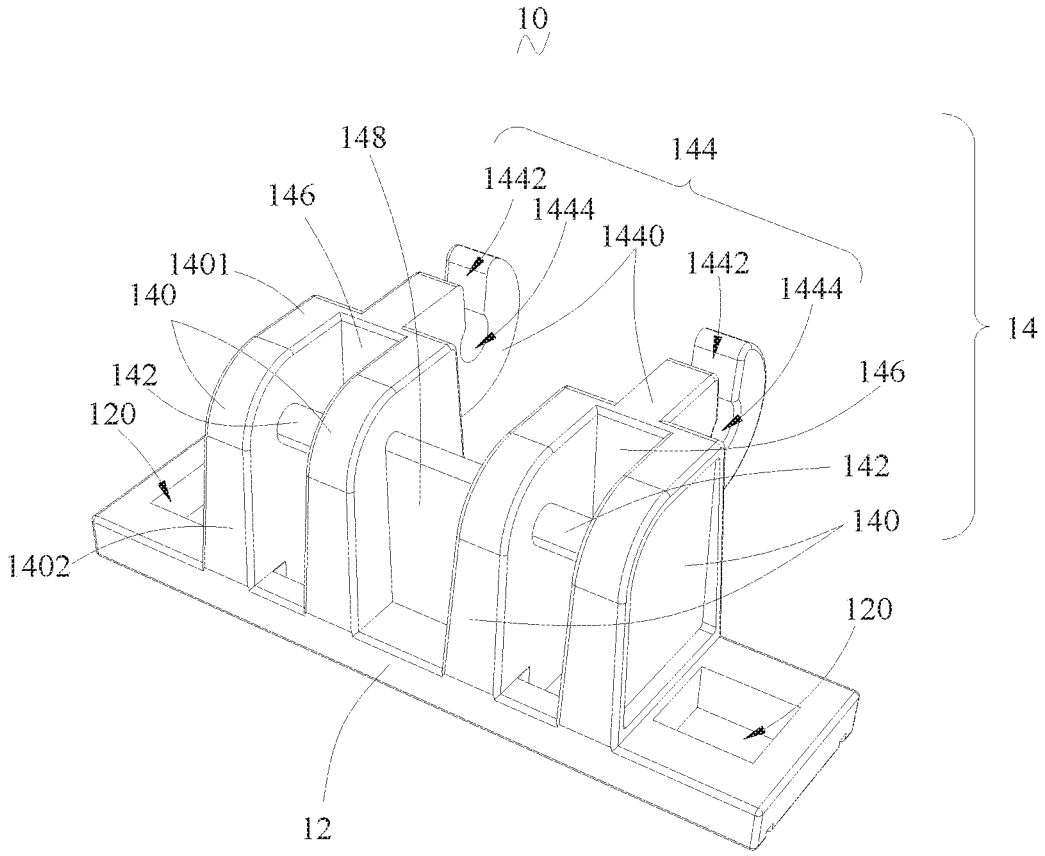
FIG. 2 is a schematic view showing a building component of the building assembly in accordance with one embodiment.

Referring to FIGS. 1 and 2, a building set 100 includes at least two building components 10 engaging with each other to form a track. Each of the building components 10 includes a base 12, a pair of fixing brackets 14 protruding from one side of the base 12, and a partition sheet 148 connected between the two fixing brackets 14. Each of the fixing brackets 14 includes a pair of parallel supporting sheets 140 facing each other, a pivot shaft 142 connected between the two supporting sheets 140, and two hook-shaped portions 144 respectively extending from the supporting sheets 140 along a direction away from the pivot shaft 142. The hook-shaped portions 144 are configured to be fastened onto the pivot shaft 142 of adjacent building components 10. The partition sheet 148 of each of the building components 10 are connected between two adjacent supporting sheets 140 of the two fixing brackets 14.

In the embodiment, the building set 100 is formed by assembling the building components 10 to form the track, and the toys, such as the tanks or the trains, may move on the track smoothly. In an example, each of the building components 10 is configured with the pivot shaft 142, and the pivot shaft 142 engages with the building portion 144 of the adjacent building component 10 such that the two adjacent building components 10 may be built together. The partition sheet 148 connects between two fixing brackets 14 of one building component 10 to form the track or an intermediate connecting component of the track. As such, the two fixing brackets 14 are stably fixed, and toys such as tanks or trains may work on the track. The structure is pretty simple and may be easily built, and the built structure is stable.

In the embodiment, the base 12, the fixing brackets 14, and the partition sheet 148 are integrally formed, and may be formed by plastic materials or other materials.

In the embodiment, the two supporting sheets 140 of each of the fixing brackets 14 is configured with a gap, and the pivot shaft 142 is configured within the gap along a horizontal direction so as to connect the two supporting sheets 140. By configuring the gap, the hook-shaped portions 144 may be rotatably fastened to the pivot shaft 142

In the embodiment, the two fixing brackets 14 are symmetrically configured at two lateral sides of a central line of the partition sheet 148. The two supporting sheets 140 of each of the fixing brackets 14 are symmetrical with respect to an axial direction of the pivot shaft 142. The hook-shaped portions 144 is arranged to be corresponding to the pivot shaft 142.

Referring to FIGS. 1 and 2, the fixing brackets 14 of each of the building blocks further includes a connecting sheet 146 arranged between the two supporting sheets 140. Each of the hook-shaped portions 144 protrudes from the connecting sheet 146 along a first horizontal direction, and the supporting sheets 140 protrude from the connecting sheet 146 along a second horizontal direction, and the first horizontal direction is opposite to the second horizontal direction. By configuring the connecting sheet 146 on the fixing brackets 14, the stability of the supporting sheets 140 connected by the pivot shaft 142 is enhanced. The connecting sheet 146 protrudes from a surface of the base 12 until one end surface of the connecting sheet 146 aligns with end surfaces of the two supporting sheets 140, such that the toy may move smoothly on the track. The hook-shaped portions 144 protrudes from the connecting sheet 146 along a direction opposite to the supporting sheets 140 so as to be fastened to the base pivot shaft 142 of the adjacent building components 10. In this way, the building components 10 may be fastened together.

Figure 3:
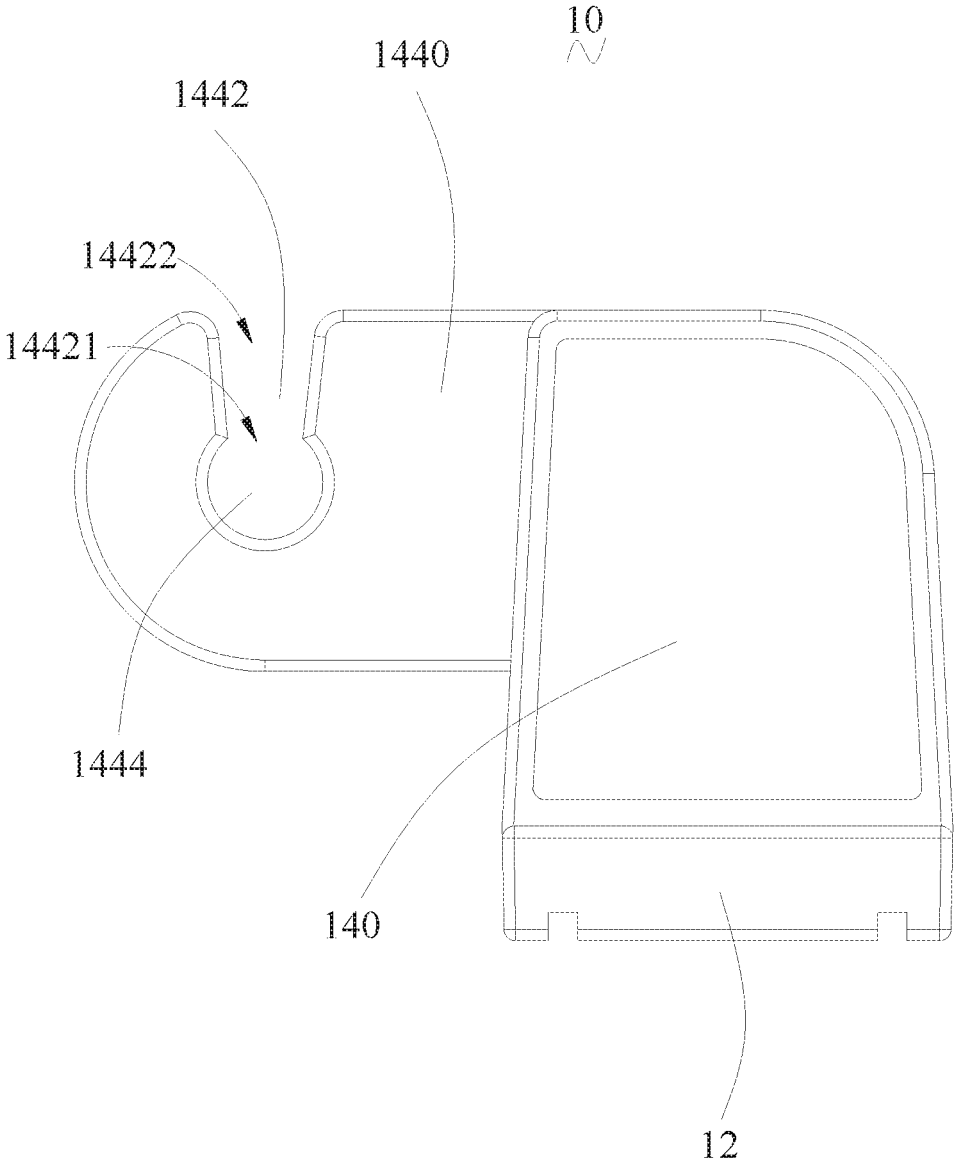
FIG. 3 is a side view of the building component of FIG. 2.

Referring to FIGS. 1 to 3, each of the hook-shaped portions 144 of the building components 10 includes an adapter board 1440 extruding from a surface of the connecting sheet 146. The adapter board 1440 is configured with an importing port 1442 and an engaging hole 1444. The importing port 1442 includes a first end 14421 and a second end 14422, and the first end 14421 is closer to the engaging hole than the second end 14422 of the importing port 1442. When the pivot shaft 142 of one building block is fastened to the adjacent building component, the pivot shaft 142 engages with the engaging hole 1444 along the second end 14422 and the first end 14421 of the importing port 1442. A diameter of the engaging hole 1444 is greater than a width of the first end 14421 of the importing port 1442. The hook-shaped portions 144 of each of the building components 10 are configured with the importing port 1442 and the engaging hole 1444, such that the pivot shaft 142 may engage with the engaging hole 1444 along the importing port 1442. That is, the pivot shaft 142 engages with the engaging hole 1444 to fasten the two adjacent building components 10.

The diameter of the engaging hole 1444 of each of the building components 10 is greater than the width of the first end 14421 of the importing port 1442. As such, the pivot shaft 142 engaged with the engaging hole 1444 may not be easily detached from the importing port 1442. In the embodiment, a diameter of the second end 14422 of the importing port 1442 is slightly greater than the diameter of other portions of the importing port 1442 such that the two adjacent building components 10 may be stably fastened. In an example, the width of the importing port 1442 is configured to be gradually decreased along a direction from the second end 14422 to the first end 14421 of the importing port 1442.

In one example, an axial length of the pivot shaft 142 is the same with the axial length of the engaging hole 1444 to form the stable structure for the track, which also avoids the building component 10 from moving axially with respect to the pivot shaft 142 of the adjacent building components 10. A height of the pivot shaft 142 is the same with the height of the engaging hole 1444 such that the adjacent building components 10 are configured to the at the same height, which further ensures the stable structure of the track.

Referring to FIGS. 1 and 2, the adapter board 1440 includes an arc surface formed at a distal end thereof. With such configuration, the building portion 144 may be easily inserted into two supporting sheets 140, and the pivot shaft 142 may engage with the engaging hole 1444 along the importing port 1442.

Referring to FIGS. 1 and 2, the supporting sheets 140 includes a top surface 1401 and a lateral surface 1402. The top surface 1401 extends from the connecting sheet 146 along the second horizontal direction, that is, the top surface 1401 is perpendicular to the connecting sheet 146. The lateral surface 1402 extends from a base 12 along a vertical direction. In one embodiment, the top surface 1401 and the lateral surface 1402 are connected by an arc surface. With such configuration, the toys may move smoothly on the track built by the building components 10.

Referring to FIGS. 1 and 2, the base 12 of each of the building components 10 is configured with a pair of expansion slots 120 arranged on outer sides of the fixing brackets 14. By configuring the expansion slots 120, the building component 10 may engage with other building components to enlarge the application scope of the building set 100. Preferably, the expansion slots 120 may be a hole passing through the base 12.

Further, a cross section of each of the expansion slots 120 along a surface parallel to the base 12 may be a rectangle or a circle. The expansion slots 120 of each of the building components 10 is configured to be rectangle or circle such that the building components 10 may engage with other building components easily, which results in a broader scope of applications.

Referring to FIGS. 1 to 4, the building block assembly includes the above building set 100, and each of the building components 10 are fastened together to form the track. In the embodiment, the building set 100 has the same structure with the building set 100 in the above embodiments.

Referring to FIGS. 1 to 4, the building block assembly further includes a rolling wheel 200 engaging with the track, and at least one power component (not shown) for driving the rolling wheel 200. It can be understood that the power component may be, but not limited to, a motor or a steering gear. The building block assembly supplies power to the rolling wheel 200 via the power component such that the rolling wheel 200 may move on the track.

Figure 4:
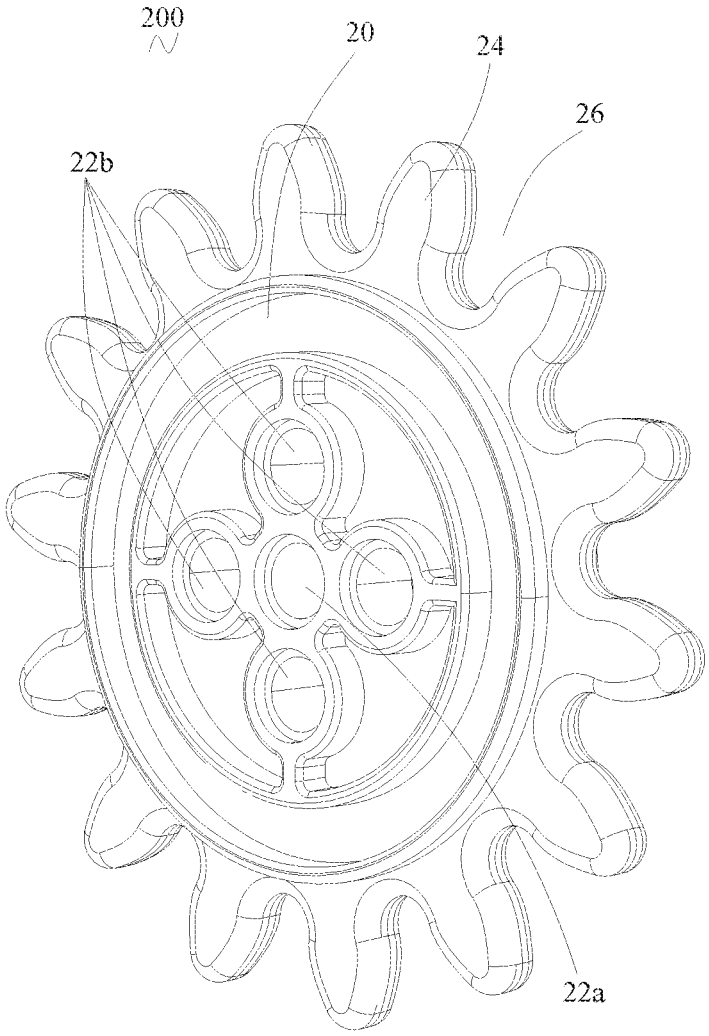
FIG. 4 is a structure view of a rolling wheel of FIG. 1.

Referring to FIGS. 1 and 4, the rolling wheel 200 includes at least one frame 20 having at least one central connecting hole 22*a* and a plurality of wheel teeth 24 surrounding an outer circumference of the frame 20, and the wheel teeth 24 are spaced apart from each other. A receiving space 149 is formed between the partition sheets 148 of two adjacent building components, and the receiving space 149 is configured to engage with the wheel teeth 24. A tooth slot 26 is formed between two adjacent wheel teeth 24. The central connecting hole 22*a* is configured to connect the power component. By configuring the wheel teeth 24 on the rolling wheel 200 to engage with the receiving space 149 between the partition sheets 148 of the adjacent building components 10, the toy may work on the track smoothly.

In an embodiment, the frame 20 also includes a plurality of connecting holes 22*b* surrounding the central connecting hole 22*a*. In an example, the rolling wheel 200 includes four connecting holes 22*b*. An axial line of the central connecting hole 22*a* is the same with a central axial line of the frame 20, and the four connecting holes 22*b* are arranged to surround the central connecting hole 22*a* on the central axial line, wherein the angle formed by the central connecting hole 22*a* on the central axial line and any one of the connecting holes 22*b* is the same.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. A building block set, comprising:

at least two building components engaging with each other, each of the building components comprising a base, a pair of fixing brackets protrusive from one side of the base, and a partition sheet connected between the two fixing brackets;

each of the fixing brackets comprising a pair of supporting sheets facing toward each other, a pivot shaft connected between the two supporting sheets, and two book-shaped portions respectively extending from the supporting sheets along a direction away from the pivot shaft; and the partition sheet of each of the building components are connected between two adjacent supporting sheets of the two fixing brackets wherein each of the fixing brackets further comprises a connecting sheet arranged between the two supporting sheets, the connecting sheet protrudes from a surface of the base, each of the hook-shaped portions protrudes from the connecting sheet along a first horizontal direction, and the supporting sheets protrude from the connecting sheet along a second horizontal direction, and the first horizontal direction is opposite to the second horizontal direction; and wherein each of the hook-shaped portions of the building components comprises an adapter board extruding from a surface of the connecting sheet along the first horizontal direction, the adapter board is configured with an importing port and an engaging hole communicating with each other, when the pivot shaft of one building component is fastened to the adjacent building component, the pivot shaft engages with the engaging hole along the importing port, the importing port comprises a first end and a second end, the first end is closer to the engaging hole than the second end, and a diameter of the engaging hole is greater than a width of the first end of the importing port.

2. The building block set as claimed in claim 1, wherein an axial length of the pivot shaft is the same with the axial length of the engaging hole, and a height of the pivot shaft is the same with the height of the engaging hole.

3. The building block set as claimed in claim 1, wherein the adapter board comprises an arc surface facing away the connecting sheet.

4. The building block set as claimed in claim 1, wherein the supporting sheet comprises a top surface and a lateral surface, the top surface extends from the connecting sheet along the second horizontal direction, and the lateral surface extends from the base along a vertical direction, and the top surface and the lateral surface are connected by an arc surface.

5. The building block set as claimed in claim 1, wherein the base of each of the building components is configured with a pair of expansion slots arranged on outer sides of the fixing brackets.

6. The building block set as claimed in claim 5, wherein a cross section of each of the expansion slots along a surface parallel to the base is a rectangle or a circle.

7. A building block assembly comprises the building block set as claimed in claim 1, and the building components are built together to form at least one track.

8. The building block assembly as claimed in claim 7, wherein the building block assembly further comprises a rolling wheel engaging with the track, the rolling wheel comprises at least one frame having at least one central connecting hole and a plurality of wheel teeth surrounding an outer circumference of the frame.

9. The building block assembly as claimed in claim 8, wherein a receiving space is formed between the partition sheets of two adjacent building components, and the receiving space is configured to engage with the wheel teeth, and a tooth slot is formed between two adjacent wheel teeth.

10. The building block assembly as claimed in claim 9, wherein the frame also comprises a plurality of connecting holes surrounding the central connecting hole, wherein the angle formed by the central connecting bole on the central axial line and any one of the connecting holes is the same.

11. A building block set configurable between an assembly state and a disassembly state, comprising:

at least two building components engaging with each other, each of the building components comprising a base, a pair of fixing brackets protrusive from one side of the base, and a partition sheet connected between the two fixing brackets;

each of the fixing brackets comprising a pair of supporting sheets facing toward each other, a pivot shaft connected between the pair of supporting sheets, and two hook-shaped portions respectively extending from the supporting sheets along a direction away from the pivot shaft; and the partition sheet of each of the building components are connected between two adjacent supporting sheets of the two fixing brackets; wherein the book-shaped portions of one building component are fastened onto the pivot shafts of one adjacent building component in the assembly state of the building block set.

12. The building block set as claimed in claim 11, wherein each of the fixing brackets further comprises a connecting sheet arranged between the two supporting sheets, the connecting sheet protrudes from a surface of the base, each of the hook-shaped portions protrudes from the connecting sheet along a first horizontal direction, and the supporting sheets protrude from the connecting sheet along a second horizontal direction, and the first horizontal direction is opposite to the second horizontal direction.

13. The building block set as claimed in claim 12, wherein each of the hook-shaped portions of the building components comprises an adapter board extruding from a surface of the connecting sheet along the first horizontal direction, the adapter board is configured with an importing port and an engaging hole communicating with each other, when the pivot shaft of one building component is fastened to the adjacent building component, the pivot shaft engages with the engaging hole along the importing port, the importing port comprises a first end and a second end, the first end is closer to the engaging hole than the second end, and a diameter of the engaging hole is greater than a width of the first end of the importing port.

14. The building block set as claimed in claim 13, wherein an axial length of the pivot shaft is the same with the axial length of the engaging bole, and a height of the pivot shaft is the same with the height of the engaging hole.

15. The building block set as claimed in claim 13, wherein the adapter board comprises an arc surface facing away the connecting sheet.

16. The building block set as claimed in claim 12, wherein the supporting sheet comprises a top surface and a lateral surface, the top surface extends from the connecting sheet along the second horizontal direction, and the lateral surface extends from the base along a vertical direction, and the top surface and the lateral surface are connected by an arc surface.

17. The building block set as claimed in claim 11, wherein the base of each of the building components is configured with a pair of expansion slots arranged on outer sides of the fixing brackets.

18. The building block set as claimed in claim 17, wherein a cross section of each of the expansion slots along a surface parallel to the base is a rectangle or a circle.

* * * * *